US005911948A

United States Patent [19]

Ratka

[11] Patent Number: 5,911,948

[45] Date of Patent: Jun. 15, 1999

[54] MACHINABLE LEAN BERYLLIUM-NICKEL ALLOYS CONTAINING COPPER FOR GOLF CLUBS AND THE LIKE

[75] Inventor: John O. Ratka, Cleveland Heights, Ohio

[73] Assignee: Brush Wellman Inc., Cleveland, Ohio

[21] Appl. No.: 08/906,236

[22] Filed: Aug. 4, 1997

[51] Int. Cl.[6] ..... C22C 19/03

[52] U.S. Cl. ..... 420/457; 420/441

[58] Field of Search ..... 148/426; 420/457, 420/441

[56] References Cited

U.S. PATENT DOCUMENTS 4,440,720 4/1984 Masumoto et al. ..... 420/457

FOREIGN PATENT DOCUMENTS 39-22492 10/1964 Japan ..... 420/441
48-34023 5/1973 Japan ..... 420/441
48-66521 9/1973 Japan ..... 420/441

*Primary Examiner*—Deborah Yee
*Attorney, Agent, or Firm*—Calfee, Halter & Griswold, L.L.P.

[57] ABSTRACT

The present invention relates to a higher order beryllium-nickel alloy containing copper represented by the formula (0.4–1.50% Be)+(0<Cu≦15%)+(0<Ti≦0.6%)+(0<C≦1.0%)+(0<Mg≦0.25%), the balance Ni, and an article constructed, at least in part, of the same. Such alloys are characterized by improved machinability with optimum combination of heat treatment response, hardness, magnetic behavior, ductility, strength and cost.

9 Claims, 5 Drawing Sheets

MACHINABLE LEAN BERYLLIUM-NICKEL ALLOYS CONTAINING COPPER FOR GOLF CLUBS AND THE LIKE

BACKGROUND OF THE INVENTION

The present invention relates generally to alloys and more particularly to a machinable, lean alloy of beryllium-nickel containing copper for golf clubs and the like.

Beryllium-nickel alloys are known for their unique combination of weight, hardness, corrosion resistance and fabrication characteristics. Also notable are their ductility, dynamic characteristics, and color. By these attributes, beryllium-nickel is desirable for use in a variety of industrial applications. Nominal 2Be—Ni alloys, for instance, have been found uniquely suited to electronic connector springs used for activating airbag safety restraint systems.

Although it is appreciated generally that these beryllium-rich alloys offer a variety of uses with extraordinary benefits, they have been found both costly and difficult to machine. Improved machinability or stress relief is typically achieved in these alloys by cold working prior to machining. In some applications, e.g., where a smooth finish is desired, cold working is considered a particularly useful method of stress relief. In other contexts, however, there may be no opportunity during processing to cold work; for example, with products made by either casting or hot forming followed by direct thermal treatment and finishing. For these reasons, cost and machinability considerations have limited the widespread commercial application of beryllium-nickel alloys.

SUMMARY OF THE INVENTION

It is therefore an object of the present invention to provide improved machinability, reduced cost beryllium-nickel alloys for commercial applications.

Another object of the present invention is to provide affordable beryllium containing alloys with application appropriate properties.

A further object of the present invention is to provide readily machinable alloys without sacrificing hardness or ductility.

Still another object of the present invention is to expand the commercial feasibility of beryllium alloys.

Yet another object of the present invention is to provide superior performance golf clubs and the like.

A further object of the present invention is to provide lower cost electronic connectors for industrial applications.

According to one aspect of the present invention is a higher order beryllium-nickel alloy containing copper represented by the formula (0.4–1.50% Be)+(0<Cu≦15%)+(0<Ti≦0.6%)+(0<C≦1.0%)+(0<Mg≦0.25%), the balance Ni, characterized by improved machinability and an optimum combination of heat treatment response, hardness, ductility, strength and cost.

In accordance with another aspect of the present invention is a higher order beryllium-nickel alloy containing copper represented by the formula (1.0–1.50% Be)+(10–15% Cu)+(0<Ti≦0.6%)+(0.75≦C≦1.0%)+(0.10≦Mg≦0.25%), the balance Ni, characterized by improved machinability and an optimum combination of heat treatment response, variable hardness, magnetic behavior, ductility, strength and cost, hardness being generally within a range of 44 HRA and 73 HRA.

According to a further aspect of the present invention is a higher order beryllium-nickel alloy containing copper represented by the formula (0.8–1.50% Be)+(0–5% Cu)+(0<Ti≦0.6%)+(0<C≦1.0%)+(0<Mg≦0.25%), the balance Ni, having superior machinability and heat treatment response with enhanced ductility and a hardness generally within a range of 44 HRA and 58 HRA.

According to yet another aspect of the present invention is a golf club head comprising, at least in part, a higher order beryllium-nickel alloy containing copper represented by the formula (0.4–1.50% Be)+(0<Cu≦15%)+(0<Ti≦0.6%)+(0<C≦1.0%)+(0<Mg≦0.25%), the balance Ni, characterized by improved machinability and an optimum combination of heat treatment response, hardness, ductility, strength and cost.

In accordance with still another aspect of the present invention is a golf club head comprising, at least in part, a higher order beryllium-nickel alloy containing copper represented by the formula (1.0–1.50% Be)+(10–15% Cu)+(0<Ti≦0.6%)+(0.75≦C≦1.0%)+(0.10<Mg≦0.25%), the balance Ni, characterized by improved machinability and an optimum combination of heat treatment response, variable hardness, magnetic behavior, ductility, strength and cost, hardness being generally within a range of 44 HRA and 73 HRA.

According to a further aspect of the present invention is a golf club head comprising, at least in part, a higher order beryllium-nickel alloy containing copper represented by the formula (0.8–1.50% Be)+(0–5% Cu)+(0<Ti≦0.6%)+(0<C≦1.0%)+(0<Mg≦0.25%), the balance Ni, having superior machinability and heat treatment response with enhanced ductility and a hardness generally within a range of 44 HRA and 58 HRA.

According to another aspect of the present invention is an article comprising, at least in part, a higher order beryllium-nickel alloy containing copper represented by the formula (0.4–1.50% Be)+(0<Cu≦15%)+(0<Ti≦0.6%)+(0<C≦1.0%)+(0<Mg≦0.25%), the balance Ni, characterized by improved machinability and an optimum combination of heat treatment response, hardness, ductility, strength and cost.

In accordance with still a further aspect of the present invention is an article comprising, at least in part, a higher order beryllium-nickel alloy containing copper represented by the formula (1.0–1.50% Be)+(10–15% Cu)+(0<Ti≦0.6%)+(0.75≦C≦1.0%)+(0.10≦Mg≦0.25%), the balance Ni, characterized by improved machinability and optimum combination of heat treatment response, variable hardness, magnetic behavior, ductility, strength and cost, hardness being generally within a range of 44 HRA and 73 HRA.

According to a yet another aspect of the present invention is an article comprising, at least in part, a higher order beryllium-nickel alloy containing copper represented by the formula (0.8–1.50% Be)+(0–5% Cu)+(0<Ti≦0.6%)+(0<C≦1.0%)+(0<Mg≦0.25%), the balance Ni, having superior machinability and heat treatment response with enhanced ductility and a hardness generally within a range of 44 HRA and 58 HRA.

Although the present invention is shown and described in connection with beryllium-nickel alloys containing copper, it may be adapted, in principle, for use in connection with other precipitation hardenable materials such as aluminum, copper, titanium, iron and alloys thereof.

The invention will now be further described by reference to the following drawings which are not intended to limit the accompanying claims.

Figure 1:
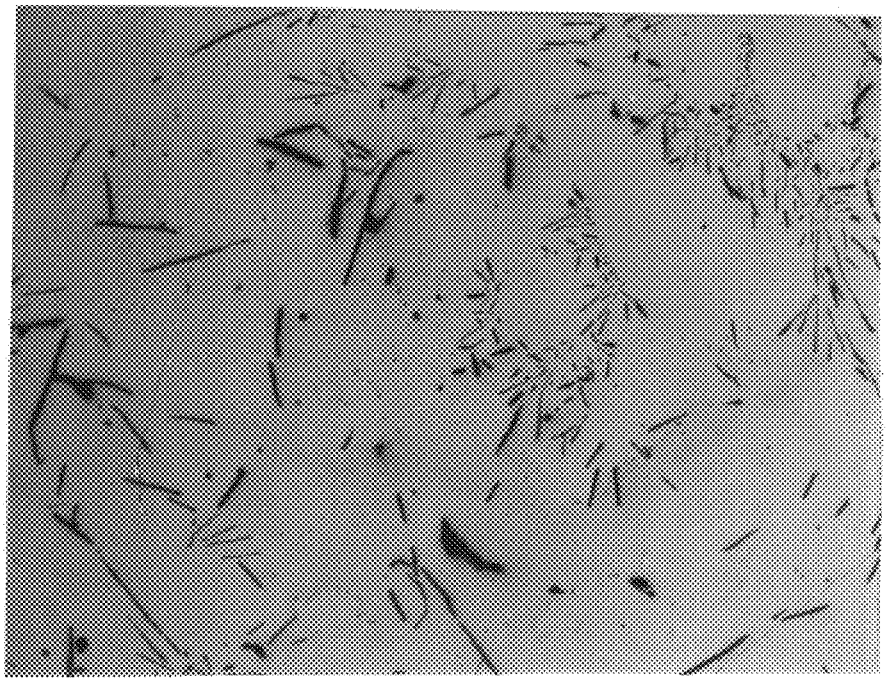
FIG. 1 is a photomicrograph of (1.0–1.50)Be–(10–15)Cu–(0<Ti≦0.6)–0.9C—Ni at 100×magnification.

Still other objects and advantages of the present invention will become apparent from the following description of the preferred embodiments.

DETAILED DESCRIPTION OF THE PREFERRED EMBODIMENTS

Referring now to the drawings and more particularly to FIGS. 1–9, there are provided higher order beryllium-nickel alloys containing copper, according to various aspects of the present invention, represented generally by the formula (0.4–1.50%Be)+(0<Cu≦15%)+(0<Ti≦0.6%)+(0<C≦1.0%)+(0<Mg≦0.25%), the balance Ni.

By the present invention, superior machinability and hot workability are achieved in lean beryllium-nickel alloys containing copper without sacrificing hardness, ductility or increasing cost. Specifically, through selected combination of carbon and magnesium, the carbon (e.g., graphite) is nodularized. This phenomena, it has been found, not only promotes chip formation in the alloys, particularly during machining operations, but also limits undesirable flake graphite morphology.

According to one embodiment of the present invention are higher order alloys represented by the formula (1.0–1.50% Be)+(10–15% Cu)+(0<Ti≦0.6%)+(0.75≦C≦1.0%)+(0<Mg≦0.25%), the balance Ni. These alloys are characterized by improved machinability with optimum combination of heat treatment response, hardness, ductility, strength and cost. Excellent hot workability, particularly in wrought form, is also achieved. Hardness is generally within a range of 44 HRA and 73 HRA.

Figure 2:
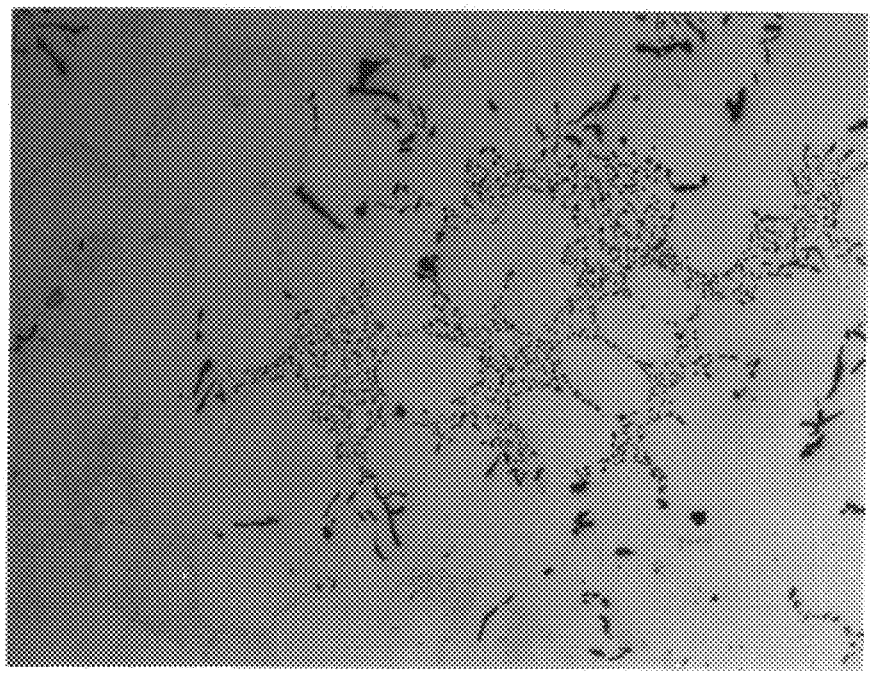
FIG. 2 is a photomicrograph of (1.0–1.50)Be–(10–15) Cu–(0<Ti≦0.6)–0.9C-0.2Mg—Ni at 100×magnification.

FIG. 1 shows the microstructure of alloys represented by the formula (1.0–1.50)Be–(10–15)Cu–(0<Ti≦0.6%)+0.9C, that is, having no magnesium additions, which exhibit an undesirable flake graphite morphology. The results of selected magnesium additions are shown in FIG. 2; the carbon is nodularized, promoting chip formation without flake graphite.

Figure 4:
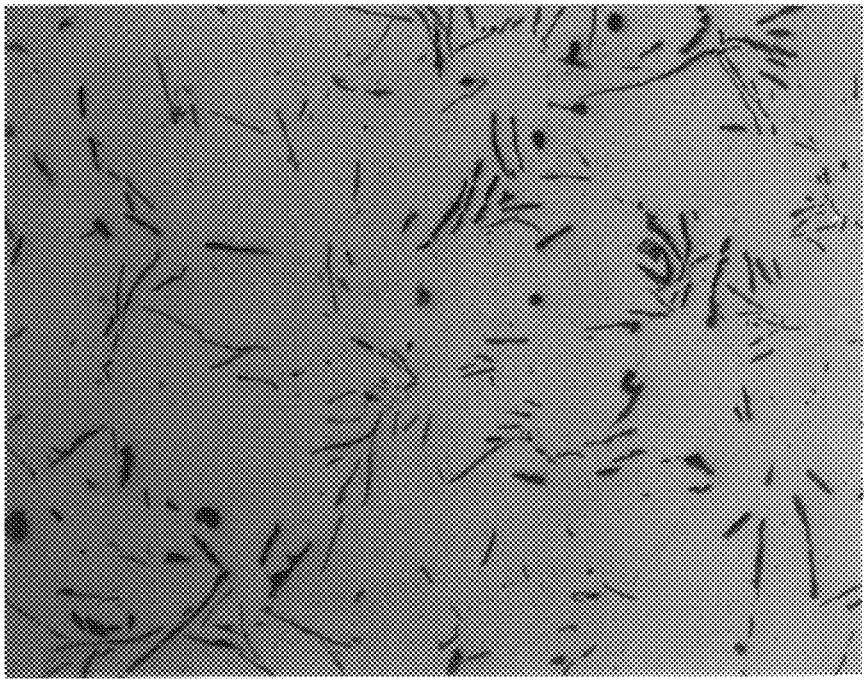
FIG. 4 is a photomicrograph of (0.8–1.50)Be–(0<Cu≦5)–(0<Ti≦0.6)–0.9C—Ni at 100×magnification.
Figure 5:
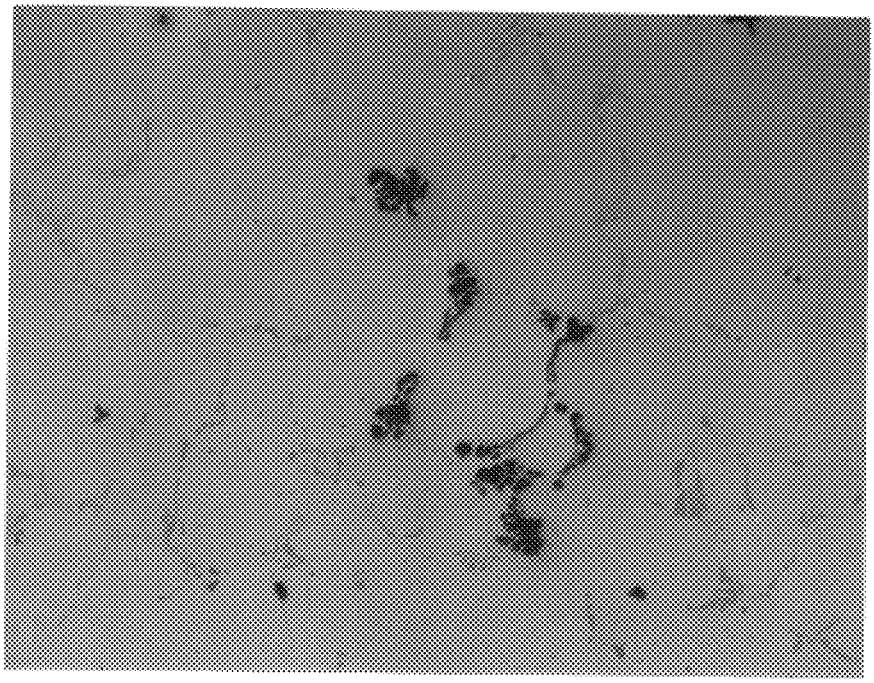
FIG. 5 is a photomicrograph of (0.8–1.50)Be–(0<Cu≦5)–(0<Ti≦0.6)–0.9C–(0<Mg≦0.25)–Ni at 100×magnification.

The nodular graphite resulting from selected carbon and magnesium additions also results in substantial improvement in machinability, e.g., during turning and grinding/polishing operations. This is illustrated generally by the micrographs of FIGS. 4–5. FIG. 4 shows the unnodularized grain structure of (0.8–1.50)Be–(0<Cu≦5)–(0<Ti≦0.6)–0.9C—Ni before the addition of magnesium. FIG. 5 illustrates a nodularized grain structure with about 0.2Mg added for improved machinability.

Alloy compositions, in accordance with the present invention, are also notable for their appreciable age hardening response in the as-cast and aged conditions, and in the solution annealed and aged conditions. This characteristic allows the adjustment of hardness levels over a broad range by selecting age hardening temperatures in the underaging, peak aging and overaging regimes, respectively. Such wide latitude in hardness is particularly useful for products such as golf clubs, where hardness grades, e.g., from long to short irons, are desired.

At relatively low beryllium compositions, e.g., generally within a range of 0.4–0.6%, the alloys present a relatively modest age hardening response in the solution annealed condition. This makes them particularly well-suited, for example, to relatively low hardness golf club heads such as putters and selected wedges. At higher beryllium levels, e.g., 0.60–1.50%, it is noted, the alloys yield appreciable age hardening response after solution annealing.

Figure 3:
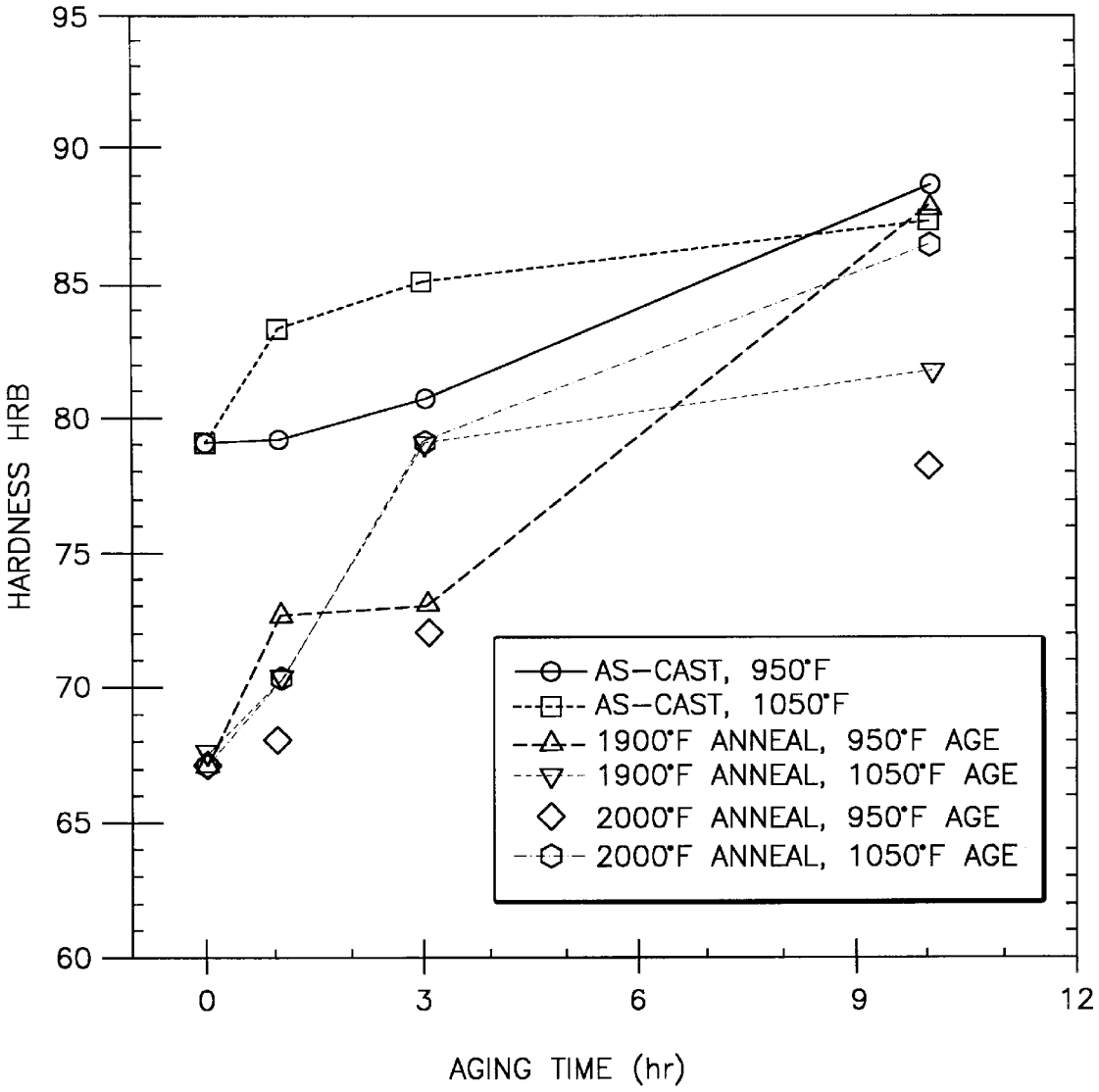
FIG. 3 is a graph of hardness (HRB) vs. aging time (hrs) showing annealing and aging response of 1.3Be-0.48Ti—Ni.
Figure 8:
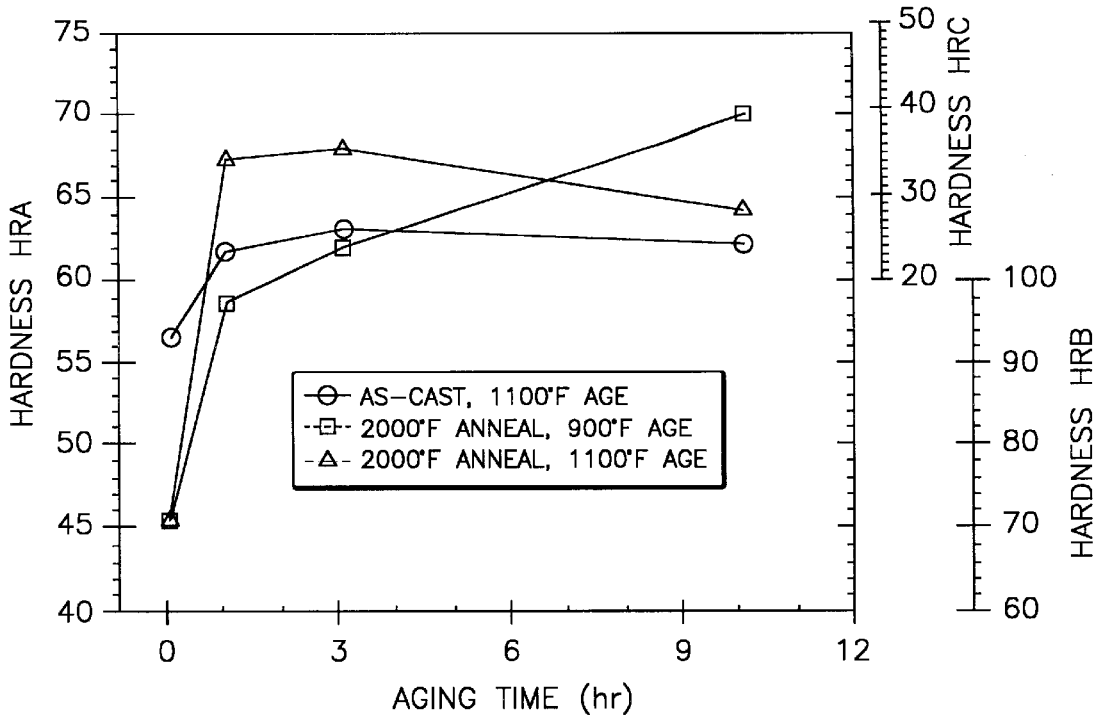
FIG. 8 is a graph of hardness (HRA) vs. aging time (hrs) showing the aging response as-cast and after annealing for 1.17Be-14.9Cu-0.5Ti-0.82C-0.18Mg—Ni.

The aging response curves of FIGS. 3 and 8 demonstrate that a moderate range of hardness can be obtained from a selected alloy composition by varying age hardening temperatures in either the cast and aged, or cast, annealed and aged conditions. In wrought form, forged golf club heads achieve hardnesses greater than those attained from the cast form without subsequent thermal treatment. This feature is desirable for a variety of golf clubs such as wedges and irons. Hardness levels achieved, in accordance with various aspects of the invention, are generally within a range of 44 HRA and 73 HRA.

In accordance with another embodiment of the present invention, there are provided higher order alloys represented by the formula (0.8–1.50% Be)+(0–5% Cu)+(0<Ti≦0.6%)+(0<C≦1.0%)+(0<Mg≦0.25%), the balance Ni. These alloys, in addition to properties elicited above, show moderate aging response in the cast-aged, cast-annealed-aged, and wrought conditions. Accompa-nied by their improved machinability and hot workability is an optimal combination of variable hardness, magnetic behavior, ductility, strength and cost. Hardnesses achieved are generally within a range of 44 HRA and 58 HRA.

As for magnetic behavior, desirable levels, like those of prior nominal 2Be—Ni alloys without copper, are exhibited at stated copper levels, even as high as about 25% Cu. Moderate magnetism, a known characteristic of beryllium-nickel alloys, is beneficial in allowing magnetic chucks to be used during secondary finishing operations for accurate positioning of golf club heads. Such levels of magnetism were attained previously only at the relatively high beryllium levels of nominal 2Be—Ni alloys, without copper.

Lean beryllium-nickel alloy formulations containing copper, according to the present invention, are further beneficial for allowing addition of beryllium as a commercially nominal (3–4)Be—Cu master alloy. These master alloys are produced by carbothermic reduction of beryllium oxide and capture of beryllium in a molten copper bath, making them inherently cheaper as a source of beryllium. The use of a beryllium-copper master alloy also increases recovery, i.e., yield, of readily oxidizable beryllium during alloying, lowering process costs further.

Conventional beryllium-nickel alloys, e.g., UNS N033060 and N03220, have required various beryllium additions in the form of metallic pebble or scrap to attain maximum strength or hardness. Pebble and scrap, however, are considered the most expensive form of beryllium for melting applications.

Turning now to product applications, alloys of the present invention are preferably wrought or cast into product. According to one aspect of the present invention, a golf club head is produced by melting the alloys, then casting the same into foundry ingots. The ingots are remelted, then cast by any commercial casting process into molds to produce cast-to-shape golf club heads. Investment casting methods are preferred.

In one embodiment, investment casting entails the melting of lean beryllium-nickel casting ingots, e.g., 5–15 lbs each, in a conventional electric furnace. The melt is then cast directly into a ceramic investment mold. The mold contains one or more cavities which conform to the desired club shape and pattern. Upon solidification and cooling, the mold is broken to remove the cast club head and casting sprue. The club head is then sectioned from the sprue and heat treated.

Processes of this general description are shown, for example, in U.S. Pat. No. 5,642,773 which issued on Jul. 1, 1997, the disclosure of which is hereby incorporated by reference herein in its entirety.

After casting, the golf club heads are solution annealed at a temperature generally within a range of 1800° F. and 2100° F., followed by rapid quenching, then age hardened to final properties at a temperature generally within a range of 800° F. and 1200° F. for about 1–16 hours.

EXAMPLE

Figure 6:
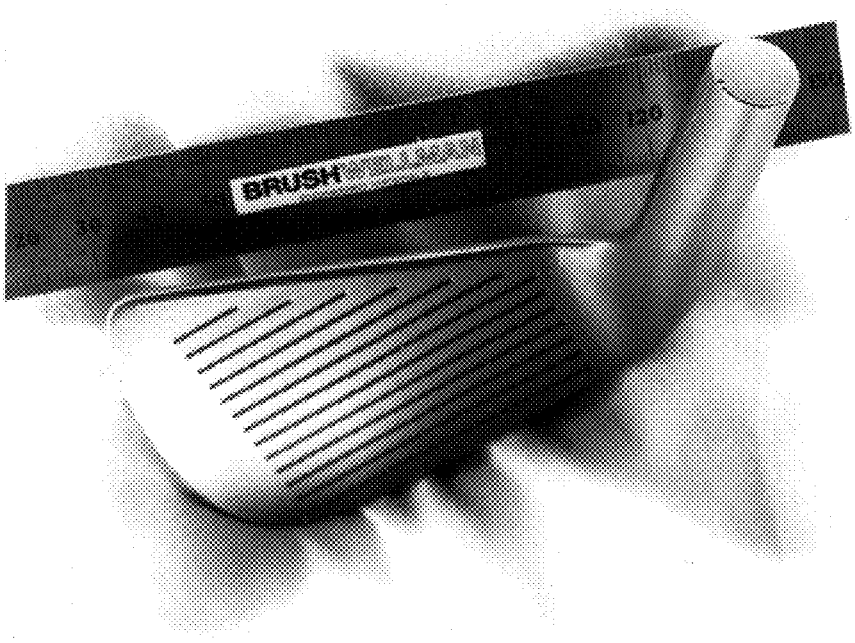
FIG. 6 shows a golf club head (known as a wedge) made by casting a beryllium-titanium-nickel alloy containing copper with cobalt and magnesium additions.

A cast golf club head with an alloy composition of 1.25Be-15.0Cu-0.48Ti—Ni balance was annealed at about 2000° F. for about 1 hour, water quenched, then age hardened at about 1100° F. for about 1 to about 10 hours to achieve desired hardness and strength. After cooling to room temperature, the club head was finish machined. An exemplary golf club head made by casting is shown in FIG. 6.

Figure 7:
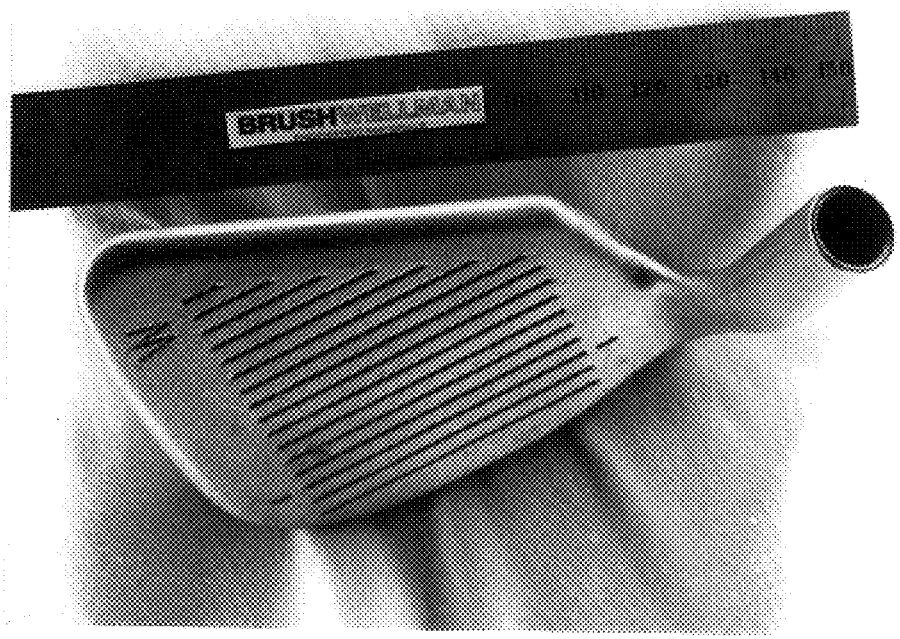
FIG. 7 shows a golf club head (known as an iron) made by forging a beryllium-titanium-nickel alloy containing copper with cobalt and magnesium additions.

Golf club heads may also be produced by forging, as shown in FIG. 7. To this end, the alloys are cast into rod or billets which are then hot worked by, e.g., extrusion or hot rolling, to rod. The hot worked rod is next hot worked by, e.g., closed die forging, to substantially final golf club head shape. The hot worked shape is then solution annealed and age hardened to final properties. Hot working is performed at a temperature generally within a range of 2000° F. and 1700° F. Solution annealing is done at a temperature between about 180° F. and about 2100° F., followed by rapid quenching. Age hardening is performed at a temperature generally within a range of 800° F. and 1200° F. for about 1–16 hours.

Examples of beryllium-nickel alloys containing copper suitable for carbon and magnesium additions, according to the present invention, are shown and described, for example, in a co-pending U.S. Patent Application filed on the same date herewith by John C. Harkness, entitled "Lean Beryllium-Nickel Alloys Containing Copper For Golf Clubs And The Like", the disclosure of which is hereby incorporated by reference herein in its entirety.

Although the present invention is shown and described in connection with beryllium-nickel alloys containing copper, it may be adapted, in principle, for use in connection with other precipitation hardenable materials such as aluminum, copper, titanium, iron and alloys thereof.

Set forth below are exemplary properties of alloys according to the present invention, in particular, for cast (1.0–1.50% Be)+(10–15% Cu)+(0.4–0.6% Ti), the balance Ni, with carbon and magnesium additions.

| | |
|---|---|
| Physical Properties | |
| Density | 0.301 (lb/in$^3$) |
| Elastic Modulus | 28.5 (106 psi) |
| Poisson's Ratio (elastic) | 0.3 |
| Liquidus Temperature | 2580° F. |
| Solidus Temperature | ~2530° F. |
| Melting and Casting Temperature | |
| Melting (Solidus) | 2550° F. |
| Casting | 2690–2770° F. |
| Electrical and Magnetic Properties | |
| Electrical Conductivity | 5–7% IACS |
| Curie Temperature | ~390° F. |
| Physical Characteristics | |
| Silver-Gray Color | |
| Non-sparkling | |
| Resistant to Oxidation | |
| Magnetic Behavior | |

Figure 9:
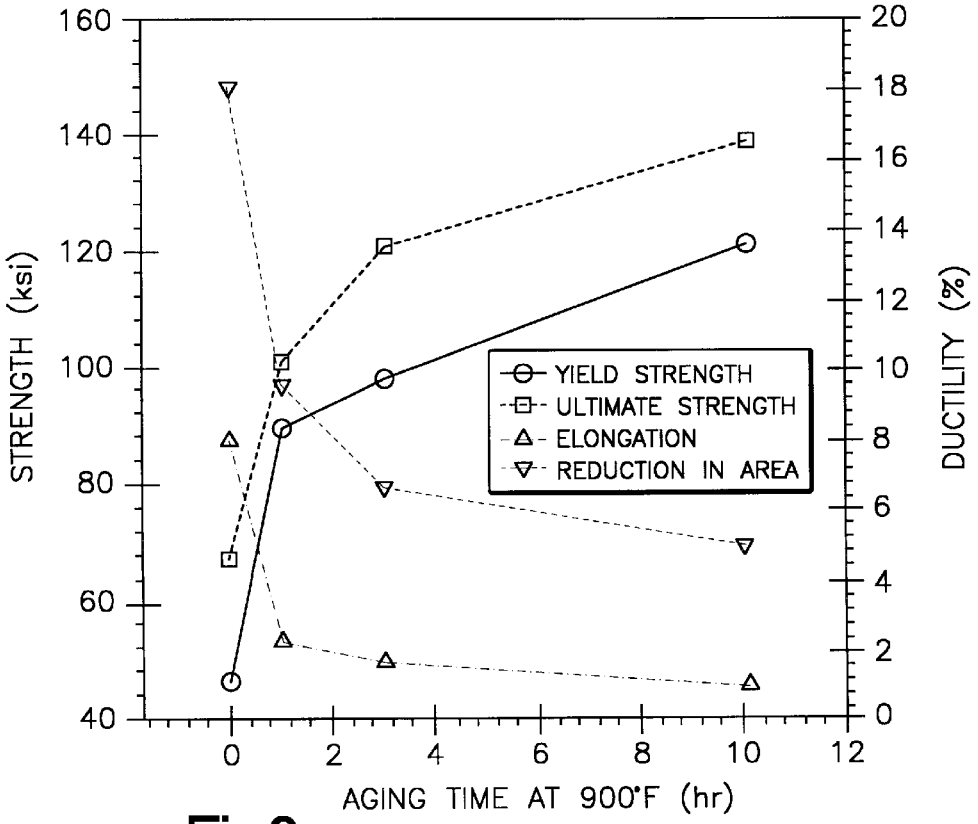
FIG. 9 is a graph of strength (ksi) vs. aging time (hrs) at 900° F. showing the tensile properties annealed and aged for 1.17Be-14.9Cu-0.5Ti-0.82C-0.18Mg—Ni.

Tensile properties of 1.17Be-14.9Cu-0.5Ti-0.82C-0.18Mg—Ni, annealed and aged, are shown graphically in FIG. 9. Strength (ksi) and ductility (%) are plotted against aging time (hrs) at 900° F., correlating alloy yield strength, ultimate strength, elongation and reduction in area.

Alloys of the present invention have been found largely insensitive, in terms of aging response, to annealing temperatures generally within a range of 1800° F. and 2000° F. Nominal 0.5% titanium is believed to contribute more to aging response than does nominal 0.25% titanium.

Until the present invention, it was not believed that binary beryllium-nickel alloys with less than about 1.5% beryllium could be age hardened. It has now been discovered that selected additions of copper, i.e., about 10–30%, to beryllium-nickel alloys imparts substantial age hardening response to the alloys with as little as 0.75% beryllium.

Also, it has been found, the addition of about 0.4–0.6% titanium to ternary beryllium-copper-nickel alloys refines grain size when the alloys are solution annealed at a temperature generally within a range of 1800° F.–2000° F. This is unlike prior additions of 0.25% titanium nominal.

Historically, ternary beryllium-titanium-nickel alloys were believed limited to a minimum of 1.8% Be. The quaternary Be—Cu—Ti—Ni alloys of the present invention, however, are not. And selected additions of titanium, i.e., 0.4–0.6%, improve ductility of these alloys as compared to ternary alloys of similar beryllium and copper content.

Overall, the present invention effects significant reduction in the beryllium requirements for beryllium-nickel alloys and, therefore, cost as compared to conventional 2Be—Ni nominal alloys. Machinability is also considerably enhanced upon additions of both carbon and magnesium, or by the combination of the two, in both cast and wrought form. Beryllium-nickel containing copper simultaneously provides mechanical and physical properties similar to those of richer 2Be—Ni alloys but at low to moderate hardness levels, as preferred for golf club heads. Consequently, commercial viability of these alloys is expanded considerably.

While the embodiments illustrated herein have been described with reference to beryllium-nickel alloys with additions of copper, titanium, cobalt and magnesium, analogous processes are believed practicable for other compositions such as aluminum, titanium, silver, iron, and their alloys, giving consideration to the purpose for which the present invention is intended.

Moreover, while the present invention has been shown and described with reference to forged irons and cast wedges, irons may be cast and wedges forged within the spirit and scope of the invention. Application of this invention to articles or parts other than golf club heads is appreciated, in view of principles and objectives as set forth herein.

Various modifications and alterations to the present invention may be appreciated based on a review of this disclosure. These changes and additions are intended to be within the scope and spirit of the invention as defined by the following claims.

What is claimed is:

1. A higher order beryllium-nickel alloy containing copper represented by the formula (0.4–1.50% Be)+(0<Cu≦15%)+(0<Ti≦0.6%)+(0<C≦1.0%)+(0<Mg≦0.25%), the balance Ni, characterized by improved machinability and an optimum combination of heat treatment response, hardness, ductility, strength and cost.

2. A higher order beryllium-nickel alloy containing copper represented by the formula (1.0–1.50% Be)+(10–15% Cu)+(0<Ti≦0.6%)+(0.75≦C≦1.0%)+(0.10≦Mg≦0.25%), the balance Ni, characterized by improved machinability and an optimum combination of heat treatment response, variable hardness, magnetic behavior, ductility, strength and cost, hardness being generally within a range of 44 HRA and 73 HRA.

3. A higher order beryllium-nickel alloy containing copper represented by the formula (0.8–1.50% Be)+(0–5% Cu)+(0<Ti≦0.6%)+(0<C≦1.0%)+(0<Mg≦0.25%), the balance Ni, having superior machinability and heat treatment response with enhanced ductility and a hardness generally within a range of 44 HRA and 58 HRA.

4. A golf club head comprising, at least in part, a higher order beryllium-nickel alloy containing copper represented by the formula (0.4–1.50% Be)+(0<Cu≦15%)+(0<Ti≦0.6%)+(0<C≦1.0%)+(0<Mg≦0.25%), the balance Ni, characterized by improved machinability and an optimum combination of heat treatment response, hardness, ductility, strength and cost.

5. An article comprising, at least in part, a higher order beryllium-nickel alloy containing copper represented by the formula (1.0–1.50% Be)+(10–15% Cu)+(0<Ti≦0.6%)+(0.75≦C≦1.0%)+(0.10≦Mg≦0.25%), the balance Ni, characterized by improved machinability and an optimum combination of heat treatment response, variable hardness, magnetic behavior, ductility, strength and cost, hardness being generally within a range of 44 HRA and 73 HRA.

6. A golf club head comprising, at least in part, a higher order beryllium-nickel alloy containing copper represented by the formula (0.8–1.50% Be)+(0–5% Cu)+(0<Ti≦0.6%)+(0<C≦1.0%)+(0<Mg≦0.25%), the balance Ni, having superior machinability and heat treatment response with enhanced ductility and a hardness generally within a range of 44 HRA and 58 HRA.

7. A golf club head comprising, at least in part, a higher order beryllium-nickel alloy containing copper represented by the formula (0.4–1.50% Be)+(0<Cu≦15%)+(0<Ti≦0.6%)+(0<C≦1.0%)+(0<Mg≦0.25%), the balance Ni, characterized by improved machinability and an optimum combination of heat treatment response, hardness, ductility, strength and cost.

8. An article comprising, at least in part, a higher order beryllium-nickel alloy containing copper represented by the formula (1.0–1.50% Be)+(10–15% Cu)+(0<Ti≦0.6%)+(0.75≦C≦1.0%)+(0.10≦Mg≦0.25%), the balance Ni, characterized by improved machinability and an optimum combination of heat treatment response, variable hardness, magnetic behavior, ductility, strength and cost, hardness being generally within a range of 44 HRA and 73 HRA.

9. An article comprising, at least in part, a higher order beryllium-nickel alloy containing copper represented by the formula (0.8–1.50% Be)+(0–5% Cu)+(0<Ti≦0.6%)+(0<C≦1.0%)+(0<Mg≦0.25%), the balance Ni, having superior machinability and heat treatment response with enhanced ductility and a hardness generally within a range of 44 HRA and 58 HRA.

* * * * *